United States Patent [19]

De Sanctis

[11] Patent Number: 5,052,553

[45] Date of Patent: Oct. 1, 1991

[54] CONTAINER HAVING MANUALLY OPENABLE CLOSURE FOR MIXING

[76] Inventor: Attilio J. De Sanctis, R.R. 2, St-Chrysostomer, Quebec, Canada, J0S 1R0

[21] Appl. No.: 429,084

[22] Filed: Oct. 30, 1989

[30] Foreign Application Priority Data

Sep. 27, 1989 [CA] Canada ..... 613711

[51] Int. Cl.[5] ..... B65D 25/08

[52] U.S. Cl. ..... 206/219; 215/DIG. 8; 220/521; 426/115; 426/120

[58] Field of Search ..... 220/23, 521; 206/219, 206/221, 222; 215/DIG. 8; 426/112, 115, 120, 124, 87

[56] References Cited

U.S. PATENT DOCUMENTS

| | | | |
|---|---|---|---|
| 3,305,368 | 2/1967 | Bourelle | 206/219 X |
| 3,326,363 | 6/1967 | Bennett et al. . | |
| 3,743,520 | 7/1973 | Croner | 220/23 X |
| 3,779,372 | 12/1973 | De Lloret . | |
| 4,221,291 | 9/1980 | Hunt . | |
| 4,333,581 | 6/1982 | Flansburg | 426/120 X |
| 4,627,986 | 12/1986 | Bardsley et al. . | |
| 4,836,370 | 6/1989 | Bosshard | 206/222 |

FOREIGN PATENT DOCUMENTS

| | | | |
|---|---|---|---|
| 566898 | 12/1958 | Canada | 220/23 |
| 2157492 | 5/1973 | Fed. Rep. of Germany | 206/219 |
| 1035820 | 7/1966 | United Kingdom | 206/219 |

*Primary Examiner*—Bryon P. Gehman

*Attorney, Agent, or Firm*—Samuel Meerkreebs

[57] ABSTRACT

In a packaging unit comprising a container, a flexible closure mounted thereto and at least one compartment located underneath the closure within the container. The compartment is adapted to release its content in the container when the closure is peeled sufficiently therefrom. The container and the compartment are made of plastics materials whereas the flexible closure is made preferably of aluminum foil. In one embodiment, the compartment comprises frangible sections along its sidewall and its bottom wall whereby removal of the closure causes rupture of the compartment at its frangible sections thereby releasing the content of the compartment into the content of the container. In a further embodiment, the flange which extends peripheral outwards from the upper ends of the sidewalls of the compartment is heat-sealed in one section thereby completely to the closure and in another section thereof only partly thereto. Therefore, upon removal of the closure from the container, flexion forces cause the second section of the flange to separate from the underside of the closure whereby the content of the compartment can pour from an upper open-ended section thereof into the container.

16 Claims, 1 Drawing Sheet

CONTAINER HAVING MANUALLY OPENABLE CLOSURE FOR MIXING

BACKGROUND OF THE INVENTION

1. Field of the Invention

The present invention relates to containers and, more particularly, to containers having separate compartments of different contents which are admixed when the closures thereof are removed.

2. Description of the Prior Art

Multicompartmented containers are well known in the art and come in various designs dependent on the use of each container. All such containers have sidewalls, a bottom wall and a closure and also a separate chamber generally positioned under the closure. The substance contained in the separate chamber is released into the content of the container by different means.

For instance, the chamber can be made of a soluble material which dissolves when it contacts the main content of the container thereby releasing the substance of the chamber into such a content. In other containers, the separate chamber takes the form of an open-ended receptacle that overhangs the peripheral upper lip of the sidewalls of the container. Once the closure is removed, the receptacle can be picked up by hand and the content thereof poured into the container.

In some cases, the secondary compartment which overlies the base of the container is sealed with a cover from which extends upwards a tab. Once the closure of the container is removed, the tab can be pulled to disengage the cover of the secondary compartment, whereby the content of the latter mixes with that of the container.

In other applications, the chambers which are fixed to the bottom surface of the closure of the container are made of a material such as aluminum foil. A thumb pressure acting on the top surface of the closure forces the foil to rupture thus releasing the content of the chamber into the lower content of the container. U.S. Pat. No. 3,326,363 (issued on June 20, 1967 to Bennett et al.) discloses such a container.

Similarly, U.S. Pat. No. 4,221,291 (issued on Sept. 9, 1980 to Hunt) teaches a container wherein the materials are admixed when pressure is exerted downwards on the flexible closure. In the compartment, an actuating rod extends between this flexible closure and the releasable bottom wall which isolates the content of the compartment from the lower portion of the container. Depressing the flexible closure forces the actuating rod against this bottom wall thereby causing the latter to pivot open and release the aforementioned content of the compartment in the container.

In U.S. Pat. No. 4,627,986 (issued on Dec. 9, 1986 to Bardsley et al.), the opening of a container storing a pressurized fluid causes a rapid pressure drop in the container which forces a compartment immersed therein to separate thereby resulting in the release of its content in the container.

In some cases, the compartment which underlies the closure of the container is opened by using a common can opener which pierces both the closure and the bottom wall of the compartment. The content of the compartment is thus released in the container. U.S. Pat. No. 3,779,372 (issued on Dec. 18, 1973 to Gil de Lloret) is of more interest as it discloses a container having a closure provided with a tearaway strip comprising a pull ring at one end thereof. A pointed lever is secured at one end thereof to the underside of the strip and runs parallel thereto within the secondary compartment which hangs underneath the closure. As the pull ring is pulled upwards, the strip starts detaching from the closure forcing the lever to pivot downwards thereby rupturing the bottom wall of the compartment and allowing the content thereof to flow downwards into the container.

SUMMARY OF THE INVENTION

It is therefore an aim of the present invention to provide a novel and improved multi-compartment container which is of simple construction and easy to manipulate in order to release the content of a secondary compartment thereof in a further content of the container.

It is also an aim of the present invention to provide a multi-compartment container wherein the content of the secondary compartment is automatically released in the content of the container when a closure thereof is removed.

A construction in accordance with the present invention comprises a packaging unit comprising a container and the flexible closure member mounted thereto. The packaging unit further comprises at least one compartment means mounted to an inner surface of the closure member within the container. The compartment means is adapted to release a content thereof in the container when the closure member is removed sufficiently with a closure removing means from the container from a first peripheral portion of the container towards a second generally opposite peripheral portion thereof.

Another construction in accordance with the present invention comprises a packaging unit wherein the container and the compartment means are made of plastics material and wherein the flexible closure member is made of aluminum foil.

A still further construction in accordance with the present invention comprises a packaging unit having the compartment means thereof provided with a chamber including top and bottom walls and generally short sidewalls therebetween. The top wall is mounted at an upper surface thereof to the inner surface of the closure member. The chamber has frangible sections at the sidewalls and the bottom wall thereof along at least one plane. This one plane is generally perpendicular to a base of the container and to an axis colinear to a diameter joining the first and second peripheral portions of the container.

In another construction in accordance with the present invention, the compartment means comprises a chamber including top and bottom walls and generally short sidewalls therebetween. The chamber has first and second sections delimited by a junction plane. The junction plane is generally perpendicular to a base of the container and to an axis colinear to a diameter joining the first and second peripheral portions of the container. The first section of the chamber is located on a same side of the junction plane as the first peripheral portion of the container. The first section comprises a first portion of the top wall which is mounted at an upper surface thereof to the inner surface of the closure member. The second section comprises a second portion of the top wall which is detachably mounted at an upper surface thereof to the inner surface of the closure member. The second portion is adapted to separate from the closure member under a sufficient force. An opening is defined at least in the second portion of the top wall.

Therefore, pulling a tab means of the closure upwardly and rearwardly causes the closure member to peel off from the container and to fold basically at the junction plane as the second portion of the top wall of the chamber separates from the inner surface of the closure member thereby releasing in the container the content of the compartment means through the opening.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figures 1, 2, 3, 4, 5, 6:
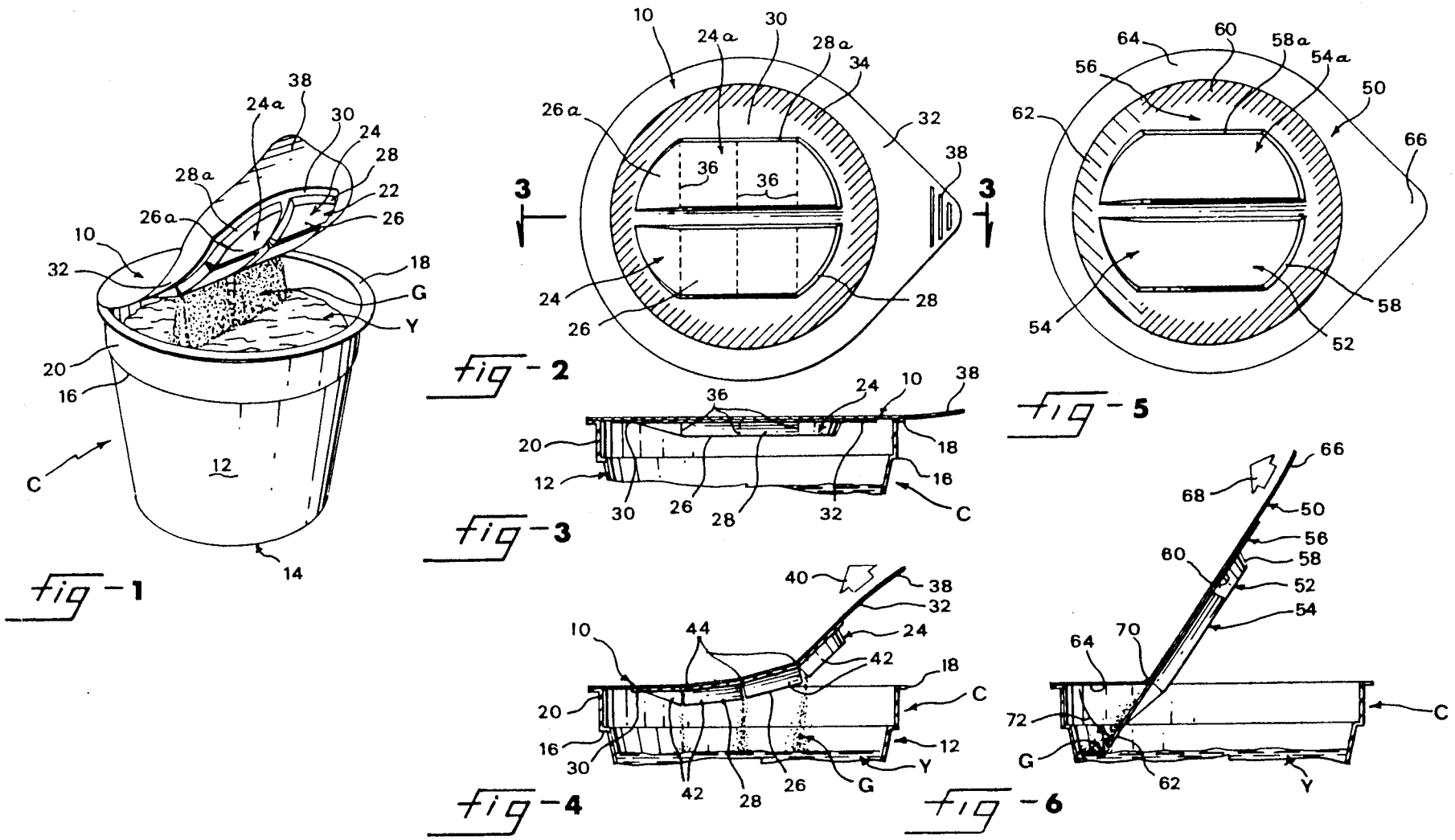
FIG. 1 is a perspective view of a container in accordance with the present invention with a closure thereof being removed therefrom.
FIG. 2 is a bottom plan view of the closure of FIG. 1.
FIG. 3 is a cross-sectional side elevation taken along lines 3—3 of FIG. 2 showing a top part of the container of FIG. 1 with the closure being sealed to the container.
FIG. 4 is a cross-sectional side elevation showing the closure being removed from the container.
FIG. 5 is a bottom plan view of a closure of an alternate embodiment in accordance with the present invention.
FIG. 6 is a cross-sectional side view of a top part of a container embodying the closure of FIG. 5 and showing the closure being removed therefrom.

In a preferred embodiment of the present invention, a yogurt container C includes a closure 10, a peripheral sidewall 12 and a base 14. The sidewall 10 and the base 14 are integral and made of a suitable plastics material.

The sidewall 12 is of general frustoconical shape having a further enlarged area indicated at 16. A peripheral flange 18 extends radially outwards of an upper end 20 of the sidewall 12.

The closure 10 which is made of aluminum foil is adhesively mounted at an annular peripheral lower surface thereof to an upper surface of the flange 18. An inner container 22 of compartmented structure preferably made of a plastics material is provided under the closure 10. In this embodiment, the inner container 22 comprises two separate chambers 24 and 24*a* of similar construction but disposed symmetrically underneath the closure 10.

Both the first and second chambers 24 and 24*a* being constructed in a same fashion, only the first chamber 24 will now be basically described. Corresponding parts of both chambers 24 and 24*a* will have the same number, the suffix "a" being added to the numbers associated with the second chamber 24*a*.

The chamber 24 includes a bottom wall 26 and short sidewalls 28 extending upwards from a periphery thereof.

A peripheral flange 30 extends outwards from upper ends of the sidewalls 28 and 28*a* thereof. If the container C is used for yogurt Y, the chambers 24 and 24*a* can be filled with a gelatin G which is isolated from the container C when the closure 10 is joined to the flange 18 by heat sealing the chambers 24 and 24*a* to an inner surface 32 of the closure 18 along a peripheral annular section 34 of the flange 30.

The flange 30 extending outwards of the chambers 24 and 24*a*, the latter are thus open-ended at upper ends thereof, whereby the chambers 24 and 24*a* are like receptacles that can be filled and then positioned under the closure 10 and heat-sealed thereto to isolate the gelatin G contained therein from the yogurt Y.

The chamber 24 is frangible at parts 36 of the bottom wall and sidewalls 26 and 28 thereof as shown in dotted lines in FIG. 2. In the illustrated embodiment, the chamber 24 is frangible along three parallel and spaced apart planes 37 which are perpendicular to the base 14 of the container and to the general direction of a pull tab 38 which is integral to the closure 10.

The frangible parts 36 can be made of a hardened plastic which is of low resiliency. Furthermore, the frangible parts 36 are of less rigidity than the remainder of the inner container 22 and will thus yield under predetermined forces.

The frangible parts 36 can also be represented by grooves defined in the bottom wall 26 and in the sidewalls 28 of the chamber 24. Again, rupture of the chamber 24 will occur at these low resiliency grooves.

FIG. 3 shows the state of the upper end part of the container C as the latter is bought by a consumer. When the consumer is ready to consume the yogurt Y, he pulls upwards and rearwards the pull tab 38 in the direction indicated by arrow 40 of FIG. 4. Since the closure 10 is flexible whereas the inner container 22 is rigid due to its thickness, flexion forces are exerted on the inner container 22 as the flexible cover is peeled from the flange 18 of the container C. The frangible parts 36 are designed to rupture under the normal forces resulting from the removal of the closure 10.

Therefore, as seen in FIG. 1 and, more particularly, in FIG. 4, the chambers 24 and 24*a* will rupture along the frangible parts 36 thereof. The different sections 42 of the chamber 24 will pivot one with respect to the other about hinges 44 of the flange 30 which are substantially colinear with the aforementioned planes 37 (FIG. 4). The rupture of the chamber 24 will allow the gelatin G to pour therefrom downwards into the yogurt Y.

The gelatin G can therefore be kept separate from the yogurt Y until the closure 10 is removed from the peripheral flange 18 of the container C. As the consumer removes the closure 10, the gelatin G is automatically released into the yogurt Y.

FIGS. 5 and 6 illustrate the container C including a further closure 50 in accordance with the present invention. In this further embodiment, only an inner container 52 of compartmented structure differs from the inner container 22 of the previous embodiment.

The inner container 52 comprises a pair of chambers 54 and 54*a* which are identical to the previous chambers 24 and 24*a* aside from not including frangible parts such as the frangible parts 36 of the chambers 24 and 24*a*. The inner container 52 has a peripheral flange 56 which extends outwards from upper ends of sidewalls 58 and 58*a* of the chambers 54 and 54*a* respectively. The flange 56 comprises first and second sections 60 and 62 meeting at a junction plane 63. The first section 60 is 100% heat-sealed to an inner surface 64 of the closure 50. The second section 62 of the flange 56 is only heat-sealed to approximately a 20% adherence to the inner surface 64 of the closure 50.

Therefore, upon pulling a pull tab 66 of the closure 50 in the direction indicated by arrow 68, the closure 50 will fold at hinge 70 which is colinear with the junction plane 73 due to the rigidity of the inner container 52 as the second section 62 of the flange 56 of the chambers 54 and 54a disengages from the inner surface 64 of the closure 50 as indicated by arrow 72. Since the chambers 54 and 54a are open-ended, an opening will be defined within the second section 62 of the flange 56 through which the gelatin G will pour into the yogurt Y.

Again, the gelatin G is poured into the yogurt Y automatically as the closure 50 is removed from the container C.

It is easily seen that the above embodiments incorporate simple constructions which allow for two different substances to be mixed only when the consumer requires it, that is when the closure of the container is removed therefrom.

I claim:

1. A packaging unit comprising an outer container and a flexible closure member detachably mounted thereto at peripheral portions thereof, an inner container mounted to an inner surface of said closure member and comprising a top wall and a bottom wall and short rigid sidewalls therebetween, said top wall being mounted at an upper surface thereof to said inner surface of said closure member, said inner container having frangible sections at said sidewalls and said bottom wall thereof along at least one plane, said at least one plane being perpendicular to a plane of said closure member and to an axis joining a first peripheral portion of said outer container and an opposite second peripheral portion thereof, said inner container having at least a partially rigid construction so that upon at least a partial removal of said closure member from said outer container in a predetermined direction from said first peripheral portion towards said second peripheral portion, sufficient flexion forces are exerted by said closure member on said inner container to cause said frangible sections to yield for releasing a content of said inner container in said outer container.

2. A packaging unit as defined in claim 1, wherein said closure member is made of aluminum foil and said inner and outer containers are made of a plastics material.

3. A packaging unit as defined in claim 1, wherein a flange extends outwardly from a peripheral upper free edge of said outer container, said closure member being adhesively mounted at an annular peripheral section thereof to an upper surface of said flange whereby said content is released in said outer container when said closure member is peeled off sufficiently therefrom.

4. A packaging unit as defined in claim 3, wherein said closure member comprises an integral pull tab, said pull tab being separate of said flange and merging with a front section of said closure member overlying said first peripheral portion of said outer container, whereby, for said at least a partial removal, said pull tab is grasped and pulled upwards and rearwards in said predetermined direction.

5. A packaging unit as defined in claim 1, wherein said inner container has further frangible sections at said sidewalls and said bottom wall along spaced apart planes parallel to and spaced apart from said at least one plane.

6. A packaging unit as defined in claim 5, wherein said top wall of said inner container is a further flange extending peripherally outwardly from upper edges of said sidewalls.

7. A packaging unit as defied in claim 6, wherein said further flange is heat sealed on 100% of its area to said inner surface of said closure member.

8. A packaging unit as defined in claim 1, wherein two symmetrical inner containers are provided one on each side of said axis thereby defining a reinforcement channel therebetween colinear to said axis.

9. A packaging unit as defined in claim 1, wherein said inner container is made of a plastics material, and wherein said frangible sections are made of hardened plastic, whereby, upon said at least a partial removal of said closure member, said frangible sections rupture along said at least one plane with parts of said inner container pivoting relative to one another about a portion of said top wall of said inner container coplanar to said at least one plane, openings being thus defined in each of said parts of said inner container, said content of said inner container releasing through said openings into said outer container.

10. A packaging unit as defined in claim 1, wherein said inner container is made of a plastics material and wherein grooves are defined in said frangible sections, said grooves being coplanar with said at least one plane and being of low resiliency, whereby, upon said at least a partial removal of said closure member, said frangible sections rupture along said grooves with parts of said inner container pivoting relative to one another about a portion of said top wall of said inner container coplanar to said at least one plane, openings being thus defined in each of said parts of said inner container, said content of said inner container releasing through said openings into said outer container.

11. A packaging unit comprising an outer container and a flexible closure member detachably mounted thereto, an inner container mounted to an inner surface of said closure member and comprising a top wall and a bottom wall and rigid short sidewalls therebetween, said inner container having a first section and a second section delimited by a junction plane, said junction plane being perpendicular to a plane of said closure member and to an axis joining a first peripheral portion of said outer container and an opposite second peripheral portion thereof, said first section of said inner container being located on a same side of said junction plane as said first peripheral portion of said outer container, said first section comprising a first portion of said top wall which is mounted at an upper surface thereof to said inner surface of said closure member, said second section comprising a second portion of said top wall which defines an opening and which is detachably mounted at an upper surface thereof to said inner surface of said closure member whereby said opening is closed by said closure member, said second portion being adapted to separate from said closure member under a sufficient force for exposing said opening, said inner container having at least a partially rigid construction so that upon at least a partial removal of said closure member from said outer container in a predetermined direction from said first peripheral portion towards said second peripheral portion, said closure member folds at said junction plane as said second portion of said top wall of said inner container separates from said inner surface of said closure member under the flexion forces exerted by said closure member on said inner container thereby releasing in said outer container a content of said inner container through said opening.

12. A packaging unit as defined in claim 11, wherein said first and second portions of said top wall of said inner container are heat sealed to said inner surface of said closure member at two different intensities.

13. A packaging unit as defined in claim 12, wherein said first and second portions of said top wall are sealed respectively on 100% and 20% of their respective areas to said inner surface of said closure member.

14. A packaging unit as defined in claim 11, wherein said closure member is made of aluminum foil and said inner and outer containers are made of a plastics material.

15. A packaging unit as defined in claim 11, wherein a flange extends outwardly from a peripheral upper free edge of said outer container, said closure member being adhesively mounted at an annular peripheral section thereof to an upper surface of said flange whereby said content is released in said outer container when said closure member is peeled off sufficiently therefrom.

16. A packaging unit as defined in claim 15 wherein said closure member comprises an integral pull tab, said pull tab being separate of said flange and merging with a front section of said closure member overlying said first peripheral portion of said outer container, whereby, for said at least a partial removal, said pull tab is grasped and pulled upwards and rearwards in said predetermined direction.

* * * * *